US008893728B2

(12) United States Patent
Wright-Frohnhoefer

(10) Patent No.: US 8,893,728 B2
(45) Date of Patent: Nov. 25, 2014

(54) VERSATILE HAIR COLOR APPLICATOR AND RELATED KITS AND METHODS

(71) Applicant: Tina Wright-Frohnhoefer, Magnolia, TX (US)

(72) Inventor: Tina Wright-Frohnhoefer, Magnolia, TX (US)

(73) Assignee: Tina Wright-Frohnhoefer, Magnolia, TX (US)

( * ) Notice: Subject to any disclaimer, the term of this patent is extended or adjusted under 35 U.S.C. 154(b) by 0 days.

(21) Appl. No.: 14/038,062

(22) Filed: Sep. 26, 2013

(65) Prior Publication Data

US 2014/0090659 A1 Apr. 3, 2014

Related U.S. Application Data

(60) Provisional application No. 61/707,448, filed on Sep. 28, 2012.

(51) Int. Cl.

| | |
|---|---|
| ***A61K 8/18*** | (2006.01) |
| ***A61Q 5/08*** | (2006.01) |
| ***A61Q 5/10*** | (2006.01) |
| ***A45D 24/22*** | (2006.01) |
| ***A45D 2/00*** | (2006.01) |
| ***A45D 37/00*** | (2006.01) |
| ***B65D 25/08*** | (2006.01) |
| ***A45D 19/02*** | (2006.01) |
| ***A45D 34/04*** | (2006.01) |
| *A45D 19/00* | (2006.01) |

(52) U.S. Cl.

CPC ..... *A45D 19/02* (2013.01); *A45D 24/22* (2013.01); *A45D 34/04* (2013.01); *A45D 2019/0066* (2013.01); *A45D 2200/058* (2013.01); *A45D 2200/25* (2013.01)

USPC ..... 132/208; 132/112; 132/221; 206/219

(58) Field of Classification Search

CPC ..... A45D 19/02; A45D 24/22; A45D 34/04; A45D 2019/0066; A45D 2019/0083; A45D 2019/0091; A45D 2200/058; A45D 2200/25; B65D 81/325; B65D 81/3255; B65D 81/3272

USPC ..... 132/208, 200, 112, 209, 218, 108, 109, 132/110, 111, 221, 270, 286, 317, 318, 320, 132/113–116; 401/4, 16, 23, 25–27, 401/137–139, 261, 265, 266, 133, 135, 176, 401/182; 206/581, 219, 277, 1.8, 361, 362, 206/823, 221; 221/64, 65; 222/133, 134, 222/139, 142.2, 142.7, 189.03, 145.1, 94, 222/519, 145.6, 145.7, 129; 8/405, 527, 8/408

See application file for complete search history.

(56) References Cited

U.S. PATENT DOCUMENTS

| | | | | | |
|---|---|---|---|---|---|
| 2,798,488 | A | * | 7/1957 | Hall | 604/82 |
| 2,802,604 | A | * | 8/1957 | Ebberts | 222/207 |
| 3,290,017 | A | * | 12/1966 | Davies et al. | 366/130 |
| 3,404,811 | A | * | 10/1968 | Cernei | 222/83 |

(Continued)

*Primary Examiner* — Vanitha Elgart

(74) *Attorney, Agent, or Firm* — D'Ambrosio & Menon, PLLC; Usha Menon

(57) ABSTRACT

A quick and convenient method for coloring hair is disclosed. According to an embodiment, a hair dye applicator is provided. The hair dye applicator includes two containers that can be locked together prior to use. Each container can include at least one hair dye component. In one embodiment, a first container can include a hair color component while the second container can include a developer.

16 Claims, 4 Drawing Sheets

(56) References Cited

U.S. PATENT DOCUMENTS

| | | | | |
|---|---|---|---|---|
| 3,410,444 | A * | 11/1968 | Morane | 206/219 |
| 4,599,008 | A * | 7/1986 | Furlong et al. | 401/133 |
| 4,779,722 | A * | 10/1988 | Hall | 206/221 |
| 4,993,437 | A * | 2/1991 | Kimura et al. | 132/112 |
| 5,337,764 | A * | 8/1994 | McKay | 132/116 |
| 5,778,902 | A | 7/1998 | Nagy | |
| 6,209,548 | B1 * | 4/2001 | Harrison et al. | 132/74.5 |
| 6,254,294 | B1 * | 7/2001 | Muhar | 401/26 |
| 6,336,763 | B1 * | 1/2002 | Losier et al. | 401/205 |
| 6,660,047 | B1 * | 12/2003 | Stanley, III | 8/527 |
| 6,691,712 | B2 | 2/2004 | Chu et al. | |
| 6,976,494 | B2 | 12/2005 | Wayne et al. | |
| 7,018,089 | B2 * | 3/2006 | Wenz et al. | 366/130 |
| 7,243,660 | B2 * | 7/2007 | Capristo | 132/208 |
| 7,252,091 | B1 * | 8/2007 | Wayne et al. | 132/112 |
| 7,568,486 | B2 * | 8/2009 | Vrus | 132/208 |
| 7,581,899 | B2 * | 9/2009 | May et al. | 401/133 |
| 7,631,645 | B2 * | 12/2009 | Gayton et al. | 132/112 |
| 7,647,933 | B2 * | 1/2010 | Morgenstern et al. | 132/114 |
| 7,891,899 | B2 * | 2/2011 | Tani | 401/266 |
| 8,118,036 | B2 * | 2/2012 | Wang et al. | 132/113 |
| 2002/0136588 | A1 * | 9/2002 | Hanna | 401/19 |
| 2004/0251147 | A1 * | 12/2004 | Schmid | 206/219 |
| 2005/0072442 | A1 | 4/2005 | Licari et al. | |
| 2005/0211261 | A1 * | 9/2005 | Capristo | 132/112 |
| 2006/0180496 | A1 * | 8/2006 | Miner et al. | 206/581 |
| 2006/0210351 | A1 * | 9/2006 | Losier et al. | 401/266 |
| 2007/0020038 | A1 * | 1/2007 | Tani | 401/265 |
| 2008/0060665 | A1 * | 3/2008 | Umeno et al. | 132/112 |
| 2008/0105328 | A1 * | 5/2008 | Desmond | 141/2 |
| 2008/0138145 | A1 * | 6/2008 | Kwon | 401/266 |
| 2008/0142032 | A1 * | 6/2008 | Liberty et al. | 132/200 |
| 2008/0283083 | A1 * | 11/2008 | Piao | 132/317 |
| 2008/0308117 | A1 * | 12/2008 | Wright et al. | 132/112 |
| 2009/0014021 | A1 * | 1/2009 | Gayton et al. | 132/200 |
| 2009/0152267 | A1 * | 6/2009 | May et al. | 220/23.83 |
| 2010/0307935 | A1 * | 12/2010 | Jessop et al. | 206/219 |
| 2013/0081647 | A1 * | 4/2013 | Vohra et al. | 132/221 |

* cited by examiner

VERSATILE HAIR COLOR APPLICATOR AND RELATED KITS AND METHODS

PRIORITY CLAIM

This application claims the benefit of U.S. Provisional Application No. 61/707,448, filed Sep. 28, 2012, the disclosure of which is hereby incorporated by reference in its entirety.

BACKGROUND AND SUMMARY

The present disclosure relates to cosmetics. In particular, the present disclosure relates to a hair dye applicator.

In one embodiment, a hair dye applicator includes a first container, wherein the first container comprises a first hair dye component; and a second container, wherein the second container comprises a second hair dye component. At least a portion of a first end of the second container is releasably coupled to a second end of the first container such that a contiguous conduit is defined for the first hair dye component and the second hair dye component. A first end of the first container comprises an outlet having a removable closure. Upon removal of the closure, a mixture of the first hair dye component and the second hair dye component is dispensed from the outlet.

In another embodiment, a method of dyeing hair, comprises providing the hair dye applicator, engaging the first container and the second container such that a contiguous conduit is defined for the first hair dye component and the second hair dye component; and mixing the first hair dye component and the second hair dye component.

In yet another embodiment, a hair dye applicator kit comprises a plurality of hair dye applicators and a housing for the applicators.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
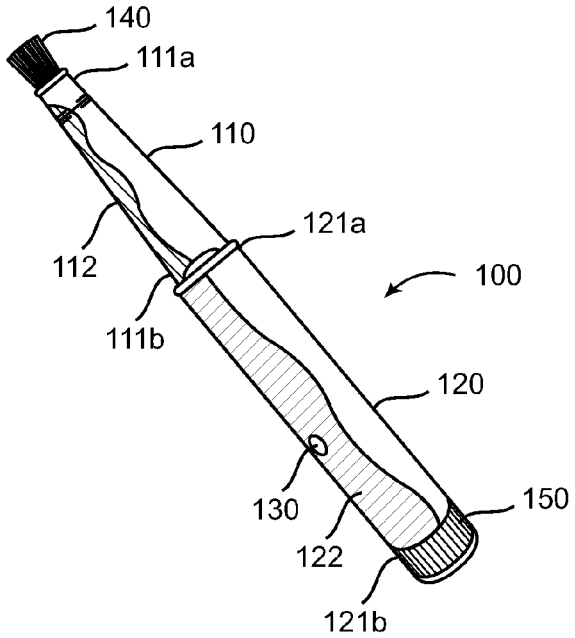
FIG. 1 is a perspective view of a hair dye applicator according to one embodiment of the invention.

As used herein, the words "comprise," "have," "include," and all grammatical variations thereof are each intended to have an open, non-limiting meaning that does not exclude additional elements or steps.

Men and women have colored their hair for cosmetic reasons from time immemorial. In the past, primarily plant based colors were used to dye hair. With advances in chemistry, most hair dyes currently include a combination of chemicals and natural ingredients. These allow the colors to last longer and also allow for the application of various colors to produce streaks or gradations.

The most common method to color hair is through the use of permanent or semi-permanent hair coloring. Permanent hair colors include a color component and an oxidizer/developer. Typically, the developer and the color component are sold in separate tubes and/or containers. Prior to use, the containers for the color component and the developer are opened and their contents are poured into a mixing tray. The contents of the tray are stirred and a desired amount of the resulting mixture is applied to the hair with a brush. The contents of the tray are exposed to the atmosphere. Any unused mixture has to be discarded since it is oxidized upon exposure to air and loses its coloring effectiveness within a few hours.

Traditional hair dyes can be messy to use and can give off a strong odor. Additionally, since only a small amount of dye is required to color portions or sections of the hair, such as for root touch up, or to color the hair on eyebrows or beard/mustaches, the user would typically have to end up discarding a bulk of the unused product. At times, only after the unused product has been discarded do users notice that a small portion of the hair was left uncolored (for example, a few stray strands were missed) during the original color treatment. In some cases, new grey hairs can start sprouting within a day or so after the hair has been colored. In these scenarios, there is no alternative available other than to go through the coloring process again by purchasing a new color treatment package and re-applying the color. Apart from the expense involved, this can be environmentally harmful due to discarding of the unused color and it is also an inconvenient way to color hair. Some people go to a salon for color treatment but this can be even more expensive. Therefore, for all these reasons, there is a need for a convenient and inexpensive alternative to hair coloration which also allows unused dye to be stored and available for reuse.

The present disclosure relates to a method and apparatus for applying color to the hair. The embodiments of the invention enable males and females to dye small or large portions or sections of hair in a quick, convenient and cost-effective manner. The apparatus includes a hair dye applicator that dispenses hair dye. The hair dye applicator includes two containers that can be coupled together. In one or more embodiments, a first container includes a color component and the second container includes a developer. The hair dye applicator according to the embodiments of the invention provides a self-contained, easy, non-messy mixing alternative to traditional methods of hair coloration with very little clean up required. The hair dye applicator also facilitates the storage of any unused dye without any substantial decomposition and loss of efficacy of the dye mixture.

Now turning to the figures, FIG. 1 depicts a hair dye applicator 100 according to one embodiment of the invention. The hair dye applicator 100 can comprise a pen or a highlighter sized applicator that can be conveniently held between the fingers of one hand and that can be easily manipulated by a user. The hair dye applicator 100 can include a first container 110 and a second container 120. As used herein, the term "container" is understood to encompass a receptacle or a body that is capable of containing or storing a substance, namely, a hair dye component. The first container 110 and the second container 120 can be made of plastic or any other suitable material. In one embodiment, the first container 110 and/or the second material 120 can be made of a rigid material. In another embodiment, the first container 110 and/or the second material 120 can be made of a substantially elastic material. The first container 110 can include a first end 111*a* and a second end 111*b*. The first container 110 can range from about 2 inches to 4 inches in length. In one embodiment, the first container 110 can be about 2.5 inches in length. The first container 110 can have an inside diameter that ranges from about 0.5 inches to 0.85 inches. In one embodiment, the first container 110 can have an inside diameter that ranges from 0.625 inches to 0.75 inches. The first container 110 can include a first hair dye component 112. As used herein, the term "hair dye component" is understood to encompass one or fluids that facilitate hair coloration, such as, a color or color component for the hair and a developer (such as, peroxide). Color components and developers are known in the art. In one embodiment, the first hair dye component 112 can include a developer.

The second container 120 can include a first end 121*a* and a second end 121*b*. The second container 120 can range from about 2 inches to 4 inches in length. In one embodiment, the second container 120 can be about 2.75 inches in length. The second container 120 can have an inside diameter that ranges from about 0.5 inches to 0.85 inches. In one embodiment, the second container 120 can have an inside diameter that ranges from 0.625 inches to 0.75 inches. The second container 120 can include a second hair dye component 122. In one embodiment, the second hair dye component 122 can include a color component. The color component may include a permanent hair color. One end of the second container 120 can further include an end cap 150.

The second container 120 can further include a small compressed mass such as a pellet 130 or a ball bearing (BB) pellet. As used herein, the term "pellet" is understood to encompass a variety of symmetrical or geometric forms, namely, spheroids, substantially spherical shapes including a particle of powder or a larger-size sphere, squares, trapezoids, cylinders, lenticular shapes, cylinders with diagonal faces, flakes and chunks. In another embodiment, the pellet 130 can be placed within the first container 110. The pellet 130 can have a diameter between 0.1 inches to 0.3 inches. In one embodiment, the pellet 130 can have a diameter of about 0.1875 inches. The pellet 130 can be made of plastic particles, coated plastic, stainless steel, resin particles and/or mixtures thereof.

The first container 110 and the second container 120 can be substantially tubular in shape. However, the first container 110 and the second container 120 can have any suitable shape, such as, oval, rectangular, etc. In one embodiment, the first end 111*a* of the first container 110 is tapered in comparison to the second end 111*b* of the first container 110. The hair dye applicator 100 can include a device 140 for applying a desired amount of a mixture of the first hair dye component 110 and the second hair dye component 120 to a section of the hair that is required to be colored.

It should be understood that, as used herein, "first," "second," "upper," "lower" etc., are arbitrarily assigned and are merely intended to differentiate between two or more containers, positions, etc., as the case may be, and does not indicate any particular orientation or sequence. Furthermore, it is to be understood that the mere use of the term "first" does not require that there be any "second," and the mere use of the term "second" does not require that there be any "third," etc.

Figure 2A:
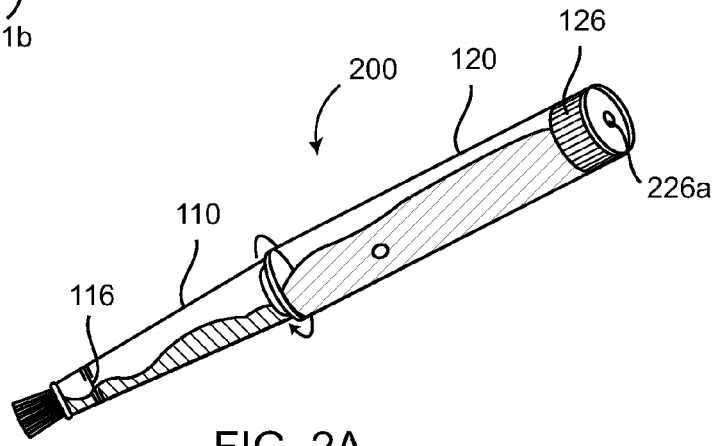
FIG. 2A is another perspective view of the hair dye applicator according to an embodiment of the invention.
Figure 2B:
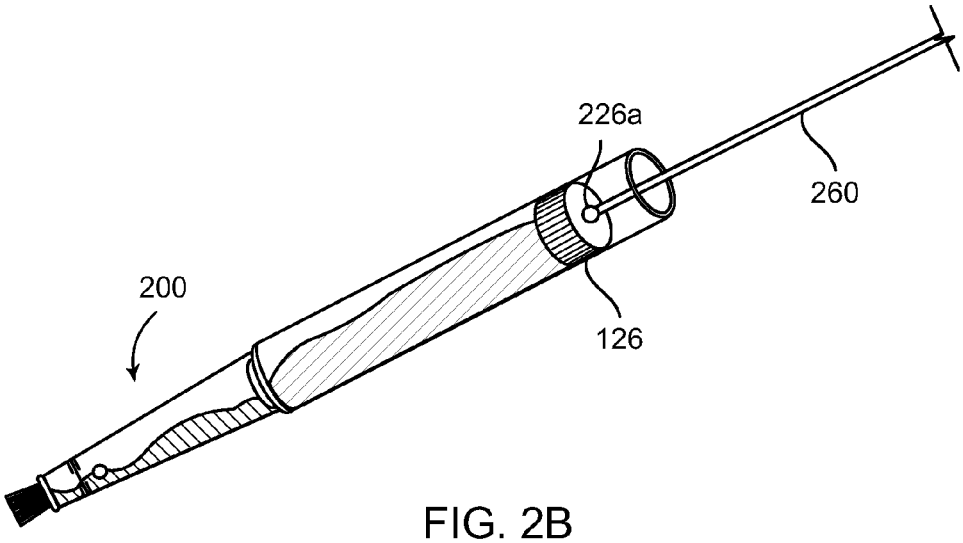
FIG. 2B is a perspective view of the hair dye applicator according to another embodiment of the invention.
Figures 2C, 2E:
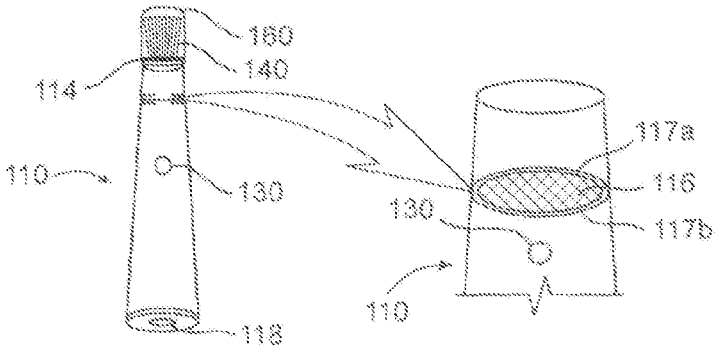
FIG. 2C is a perspective view of the hair dye applicator showing a screen according one embodiment of the invention.
FIG. 2E is a perspective view of a first container according to one embodiment of the invention.
Figure 2F:
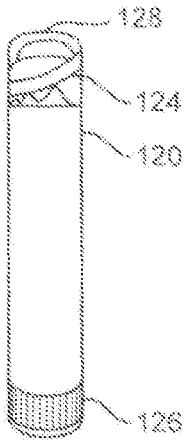
FIG. 2F is a perspective view of a second container according to one embodiment of the invention.
Figure 2D:
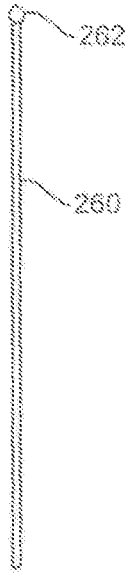
FIG. 2D is a perspective view of a shifting device according to one embodiment of the invention.

Referring now to FIG. 2A, in another embodiment, the hair dye applicator 200 can include a first container 110 and a second container 120. The second container 110 can include an end cap 126. The end cap 126 can be made of a pliable material, such as rubber or plastic. The end cap 126 can include an indentation 226*a*. As used herein, the term "indentation" is understood to encompass a depression, notch, slot or groove. A screen 116 is positioned within the first container 110.

Referring now to FIGS. 2B-2F, the hair dye applicator 200 can include the end cap 126. The end cap 126 can include the indentation 226*a*. The indentation 226*a* is configured to receive a shifting device 260. The shifting device 260 can include an elongated device, namely, a wand. The shifting device 260 can be made of a plastic material. The shifting device 260 can include a protrusion 262 at one end. The protrusion 262 can be dimensioned such that it can be fitted tightly within the indentation 226*a* in the end cap 126. The shifting device 260 can be used to push or advance the end cap 126 upward or inward within the second container 120.

As described earlier, the screen 116 is positioned within the first container 110. The first container 110 can also include the pellet 130. The screen 116 can be a mesh screen 116. The mesh size is configured such that the pellet 130 is unable to penetrate through the mesh. The screen 116 can be substantially round in shape and molded to an inside surface of the first container 110. In one embodiment, the screen 116 can interposed between an upper lip 117*a* and a lower lip 117*b* located in the first container 110.

In one embodiment, at least a portion of a first end of the second container 120 terminates in a tip 124. The tip 124 can include an aperture (not shown) to facilitate the through passage of the second dye component. In one embodiment, the second container 120 can include a cover 128 for the tip 124. The cover 128 can be made of clear plastic. The cover 128 can be snap fitted onto the tip. In another embodiment, the aperture can be tightly sealed, for example, with an aluminum foil. Other suitable mechanisms known in the art can also be employed to ensure that the second dye component is sealed and contained within the second container 120.

The tip 124 can include one or more threads. The threaded tip 124 can be substantially cone shaped. The tip 124 can be configured to mate with or engage a socket or opening 118 in the second end of the first container 110. In another embodiment (not shown), the first container 110 can include a threaded tip while second container 120 can include an opening for receiving the tip. For the purposes of this invention, it is immaterial whether the male/female joints are positioned on the first container 110 or on the second container 120.

The hair dye applicator 200 further includes a device 140 for applying a mixture of the first and second hair dye component to the hair. Referring now to FIGS. 2E, 3A and 3D-3G, the first container 110 can include a screen 116 interposed on upper lip 117*a* and lower lip 117*b*. The first container 110 can terminate in a tapered mouth/tip. The mouth/tip includes an outlet 114 through which a mixture of the first hair dye component 112 and the second hair dye component 122 are dispensed. Device 140 can be attached to the outlet 114. The device 140 can include a brush (140*a*, 140*b*), sponge, comb (140*c*, 140*d*) or any other similar device known in the art. The hair dye applicator 200 further includes a lid 160 for the device 140. The lid 160 can be dimensioned to fit over the device 140.

In another embodiment of the invention, a method of quickly and conveniently dyeing hair is disclosed. This embodiment is described in further detail with reference to FIGS. 3A-3C. The method involves providing the hair dye applicator 100. As described earlier, the hair dye applicator 100 can include two containers—a first container 110 and a second container 120. The first container 110 includes a desired or a pre-determined volume of a first hair dye component 112 and the second container 120 can include a desired or a pre-determined volume of a second hair dye component 122. The first hair dye component 112 can include an activator or developer, such as peroxide. In one or more embodiments, the first end 111*a* of the first container 110 can be substantially tapered. The first end 111*a* can terminate in an outlet 114. The second end 111*b* of the first container 110 can include an opening 118. The outlet 114 and the opening 118 are closed in a suitable manner known in the art. For example, the outlet 114 and/or the opening 118 can be closed with at least one of a twist on/off cap, a screw cap, a seal, such as, an aluminum foil, or with an adhesive. When closed, the first hair dye component 112 can be maintained within the first container 112 in a substantially air/fluid tight environment. Screen 116 can be molded to an inside surface of the first container 110. The screen 116 can be positioned toward the first end 111*a* of the first container 110. The first end 111*a* can terminate in a mouth/tip that includes an opening 114. A device 140 for applying color can be attached to the outlet 114.

Figure 3A:
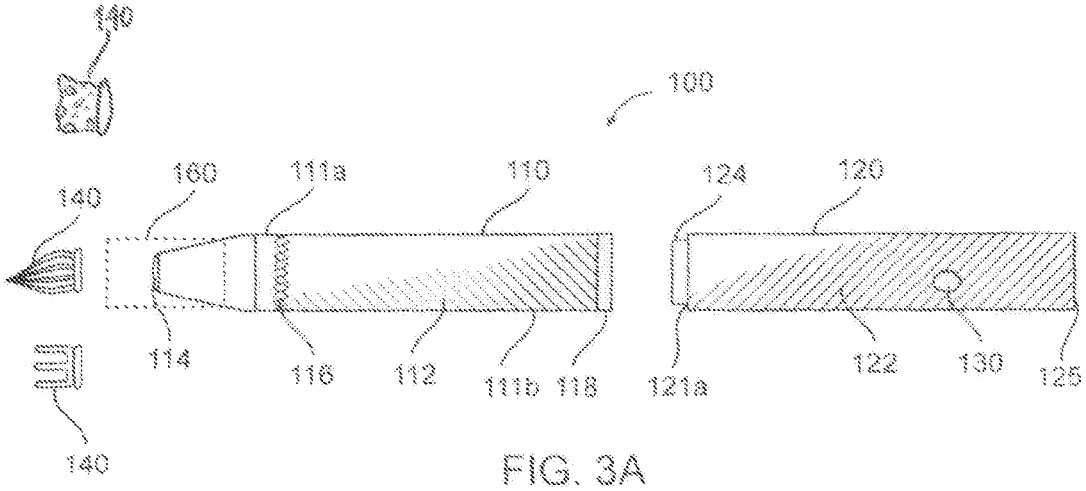
FIG. 3A is a lateral view of the applicator showing the first container and the second container and a device for applying color to the hair according to one embodiment of the invention.
Figure 3B:
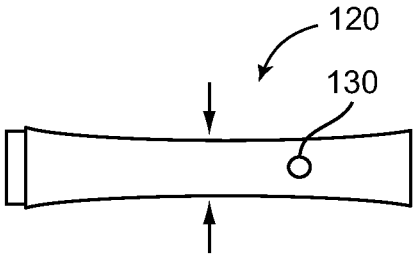
FIG. 3B is a lateral view of the second container according to one embodiment of the invention.
Figure 3C:
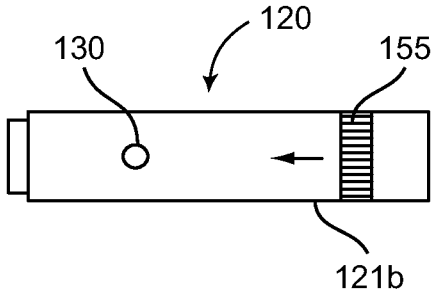
FIG. 3C is a lateral view of the second container according to another embodiment of the invention.
Figures 3D, 3E, 3F, 3G:
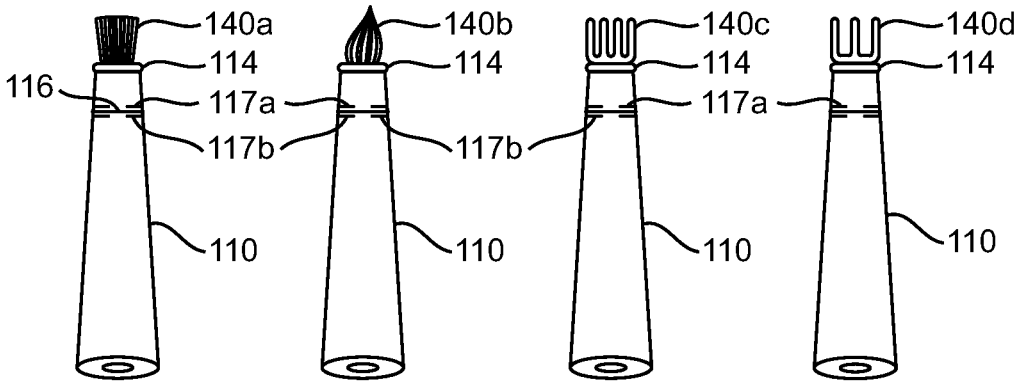
FIGS. 3D-3G are perspective views of the first container with interchangeable devices according to one or more embodiments of the invention.

The second hair dye component 122 can include a color component, namely, a permanent hair color. The second container 120 can include a pellet 130. In another embodiment, the pellet 130 can be located in the second container 120 and/or the first container 110. The first end 121*a* of the second container 120 can terminate in tip 124. As described earlier, in one embodiment, the tip 124 can include a protrusion or a male member, such as, a cone-shaped protrusion. The protrusion can include one or more apertures (not shown). In one or more embodiments, the tip 124 can have one or more threads. In one or more embodiments, the tip 124 can be configured to mate with the opening 118 in the second end 111*b* of the first container 110. In another embodiment (not shown), the second end 111*b* of the first container 110 terminates in a protrusion while the first end 121*a* of the second container 120 can include an opening. Irrespective of whether a male member is located at one end of the first container 110 or at one end of the second container 120, it is designed to substantially tightly fit into an opening or a similar female member located at one end of the second container 120 or at one end of the first container 110 respectively. In one embodiment, the second end 125 of the second container 120 can be sealed. The aperture(s) can also closed with an adhesive or an air/fluid tight seal. Accordingly, the second hair dye component 122 can also be maintained in a substantially air/fluid tight environment. In one embodiment, the second container 120 can be made of a plastic material that can be squeezed or kneaded by the application of pressure as shown in FIG. 3B. In another embodiment, first container 110 and/or the second container 120 can be made of a plastic material that can be squeezed or kneaded by the application of pressure. As described earlier, the second end 125 of the second container 120 can be sealed or it can include an indented end cap that can be moved with a shifting device. In yet another embodiment, as shown in FIG. 3C, the second end 121*b* of the second container 120 can include a cap 155 that can be twisted to advance the second hair dye component 122. When turned in a clockwise direction, for example, a threaded rod (not shown) in engagement with the cap 155 would advance the second hair dye component 122 toward the outlet 114 for dispensing.

As described earlier, the outlet 114, the aperture(s) on the tip 124 and opening 118 may all be sealed and/or covered with at least one of a protective cover/removable closure and/or a closure mechanism, such as, at least one of a twist on/off cap, a screw cap, a seal (for example, an aluminum foil), or with an adhesive. Prior to using the hair dye applicator 100, the user has to remove the protective cover (s) and/or closure mechanisms on the tip 124 and the opening 118. The first container 110 and the second container 120 are then brought in alignment with the first end 121*a* of the second container 120 facing the second end 111*b* of the first container 110. The first container 110 and the second container 120 are connected by allowing the tip 124 or the protrusion at the first end 121*a* of the second container 120 to mate with the opening 118. In one embodiment, the first container 110 and the second container 120 can be snapped together and twisted to lock them in place. Locking the first container 110 and the second container 120 creates a contiguous conduit or uninterrupted channel for the through passage of the second hair dye component 122 into the first container 110 (and vice versa).

The hair dye applicator 100 can be shaken vigorously. This facilitates the mixture of the first hair dye component 112 with the second hair dye component 122. The mixture is further facilitated by the pellet 130. The pellet 130 facilitates a substantial through mixing of the first hair dye component 112 with the second hair dye component 122. The screen 116 prevents the pellet 130 getting lodged in the outlet 114 and blocking the dispensing of the hair dye mixture. In one or more embodiments (not shown), the hair dye applicator 100 can be devoid of a pellet and/or a screen. For example, certain hair dye components do not require the presence of a pellet to facilitate mixing. Consequently, the screen can also be eliminated.

The second hair dye component 122 can be advanced from the second container toward the first container 110 for mixing with the first hair dye component 112. As described previously, the second hair dye component 122 can be advanced toward the outlet 114 for dispensing by one of several mechanisms, such as by twisting an end cap or by shifting the end cap with a shifting device or by squeezing or kneading the second container 120.

After the mixture has been shaken, a device 140 can be used to apply the mixture of the first hair dye component 112 and the second hair dye component 122 (or the "mixture") onto the hair or to a section of the hair that needs coloring. The device 140 can be attached to the outlet 114 by any mechanism known in the art. For instance, the device 140 can be snapped onto or twisted into the outlet 114. In one embodiment, the device 140 can include a brush tip or a comb tip with a flared bottom portion. The flared bottom portion of the device 140 can be coupled to the outlet 114. The device 140 can be selected based on the amount and/or location of the hair that is required to be treated or colored. In another embodiment, the device 140 can be inserted by twisting the device 140 onto the outlet 114. The mixture passes through the outlet 114 and onto the device 140.

In one embodiment, after use, the device 140 can be removed from the outlet 114. The removed device 140 can be rinsed or washed thoroughly to remove any residual mixture. The cleaned device 140 can be discarded or stored and reused. After the device 140 is removed, the outlet 114 can be covered with a lid 160. The lid 160 can be manufactured out of clear plastic. The lid 160 can be dimensioned to form a substantially air tight seal around the device 140 such that air/fluid is not allowed to penetrate into the first container 110 through the outlet 114.

In one embodiment, the opening 118 at the second end 111*b* of the first container 110 and the tip 124 at the first end 121*a* of the second container can be covered or sealed after use. For example, the opening 118 and/or the tip 124 can be covered with a cap that can be rotated/twisted in one direction to close the opening 118 and/or the tip 124 and that can allow the opening 118 and/or the tip 124 to be opened when it is rotated in an opposite direction. The cap can be made of plastic, for example, it can be made of clear plastic.

By enclosing the outlet 114 with the lid 160 and the opening 118 with the cap, any residual or unused portion of the mixture can be retained and stored within the first container 110. The lid 160 and the cap ensure that the residual mixture is stored in a substantially air/fluid tight environment. This prevents any residual mixture from being oxidized. In one embodiment, the mixture can be stored without substantial degradation for at least 3-4 days. In another embodiment, the mixture can be stored without substantial degradation for a period of 24-48 hours.

In one embodiment, the second container 120 can be discarded after one use. For example, various mechanisms have been described earlier (such as, twisting an end cap on the second container 120, using a shifting device or by applying pressure to the second container 120) to substantially completely advance or transfer the second hair dye component 122 into the first hair dye container 110 where it is mixed with the first hair dye component 112. If a pellet 130 is present within the second container 120, it too gets transferred to the first container 110 when the second hair dye component 122 is advanced (as described earlier). Conveniently, the user can then choose to retain only the first container 110 for any subsequent hair color application. In one or more embodiments, the first container 110 and/or the second container 120 can include a squeezable container.

In another embodiment, the mixture of the first hair dye component 112 and the second hair dye component 122 can be poured into a separate container such as, a tray (not shown) and the mixture can then be applied to the hair using a conventional brush or any applicator known in the art.

Figure 4A:
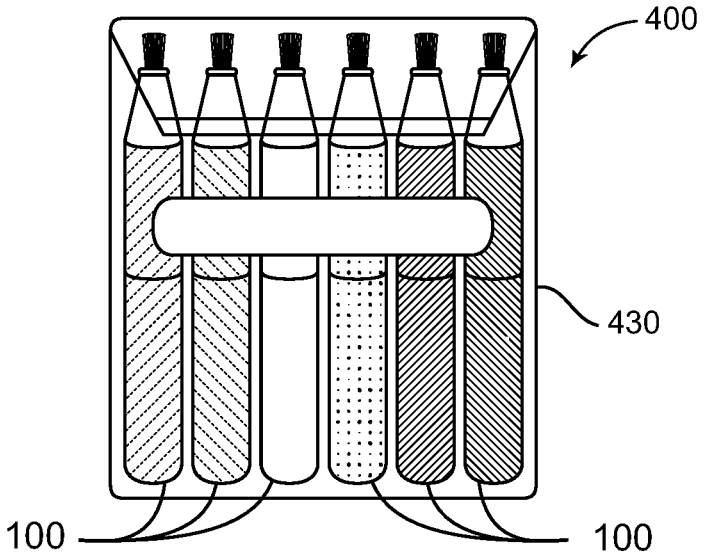
FIG. 4A is a perspective view of a hair dye applicator according to one embodiment of the invention.
Figure 4B:
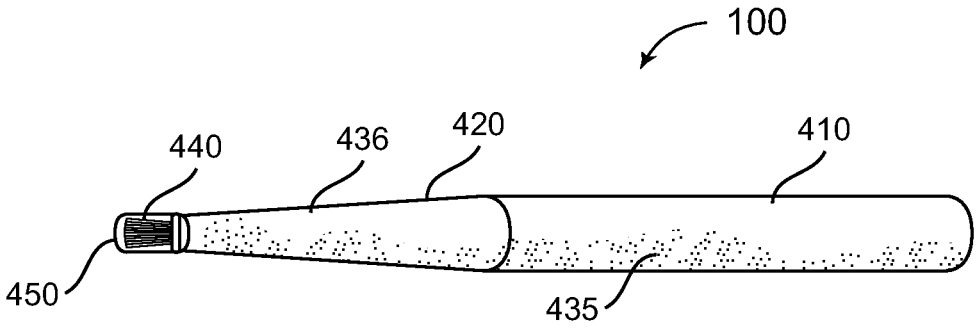
FIG. 4B is a lateral view of a hair dye applicator according to another embodiment of the invention.

In yet another embodiment, referring to FIGS. 4A and 4B, a kit 400 for dyeing hair is disclosed. The kit 400 can include a housing 430. The housing 430 can be made of paper or any suitable resilient material such as plastic. The housing 430 encloses at least one but preferably more than one, that is, a plurality, of the hair dye applicators 110 described earlier with reference to hair dye applicator 100 in FIG. 3A. In one embodiment, each hair dye applicator 110 can include a first and second container and each container can include a different hair dye component. The first or second, etc. hair dye components can include permanent colors, developers, pigments, fat-soluble dyes and mixtures thereof. This makes it convenient to interchange the components thereby facilitating mixing and matching of colors and enabling multi-color applications on the hair to fit various occasions or outfits. Alternately, a user could color scalp hair in one color and the eyebrows in a different color. Or, a user could color streaks or color multiple sections of hair in one or more colors. A color wheel (not shown) can be included to aid in mixing the color. As described earlier, in one or more embodiments (not shown), the hair dye applicator 110 can include a pellet to facilitate a substantially thorough mixing of the dye components and a screen to prevent the pellet from dislodged in an outlet for the dye mixture. In yet another embodiment (not shown), the hair dye applicator 110 does not include a pellet and/or a screen. For example, certain hair dye components are less viscous and do not require the presence of a pellet to facilitate their mixing. Consequently, the screen can also be eliminated.

The first and second, etc. hair dye components can also include glitter and water-soluble or washable dyes in various colors. The dyes can be used to highlight or color sections of the hair. There is no need for a developer with washable dyes. Accordingly, the first 410 and second 420 container can each include a different color 435, 436 for mixing when the first 410 and second 420 containers are locked together. For example, the first container 410 can include a yellow dye while the second container 420 can include a blue dye such that when the first 410 and second 420 containers are locked together and the colors are allowed to mix, a green dye is obtained. Upon mixing, the desired color can be applied using device 440. As described earlier, the hair dye applicator 110 can further include a protective or sealing cap 450.

In one embodiment, the kit 400 can be customized depending on various festive occasions. For example, a wedding/anniversary kit 400 can be customized to include one gold glitter and/or one silver glitter hair dye applicator 110; a birthday kit 400 can be customized to include multiple colors and interchangeable hair dye applicator 110 options; a holiday kit 400 (such as, Christmas) can be customized to include one red and one green glitter with gold and silver glitter hair dye applicator 110; a Halloween kit 400 can be customized to include one black and one orange hair dye applicator 110 and an Easter kit 400 can be customized to include one pine and one yellow hair dye applicator 110. Various other combinations can be devised and these are intended to be covered under the scope of the present disclosure. The kit 400 could further include a moisturizer or conditioner, instructions for use and gloves for handling the applicator 110.

The one or more embodiments of the invention provide the user with a clean, easy and convenient way to color smaller areas of hair, such as for root touch up, or to color the hair on eyebrows or beard/mustaches, or to dye larger sections of hair. The one or more embodiments prevent the user from wasting a large portion of the bottle of hair dye for coloring a small section of hair. It also eliminates the need to pour the developer and dye into a tray for mixing, which can be messy and can stain the counter tops or other surfaces, skin and clothes. Further, it reduces the amount of money spent on expensive salon visits.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, neither the first container nor the second container could include a pellet. Also, a third or fourth container could be provided wherein the additional containers include a color component or a conditioner. Each of the additional containers could be designed such that it can be snapped onto another container. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While apparatus (such as the hair dye applicator) and methods are described in terms of "comprising," "containing," or "including" various components or steps, the compositions and methods also can "consist essentially of" or "consist of" the various components and steps. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A hair dye applicator, comprising:

a first container, wherein the first container comprises a first hair dye component; and a second container, wherein the second container comprises a second hair dye component, wherein at least a portion of a first end of the second container is releasably coupled to a second end of the first container such that a contiguous conduit is defined for the first hair dye component and the second hair dye component, wherein a first end of the first container comprises an outlet having a removable closure, wherein the first container further comprises a mesh screen, wherein the mesh screen is molded to an inside surface of the first container, and further wherein the mesh screen is interposed between an upper lip and a lower lip located in the first container, and wherein, upon removal of the closure, a mixture of the first hair dye component and the second hair dye component is dispensed from the outlet.

2. The hair dye applicator according to claim 1, wherein the first container and/or the second container are substantially tubular in shape.

3. The hair dye applicator according to claim 1, wherein the first hair dye component and the second hair dye component are selected from the group consisting of a color component and a developer.

4. The hair dye applicator according to claim 3, wherein the developer is contained in the first container, and wherein the color component is contained in the second container.

5. The hair dye applicator according to claim 1, wherein the at least a portion of the first end of the second container further comprises a tip, wherein the tip comprises a sealable opening, and wherein the tip is dimensioned to engage with a groove positioned adjacent the second end of the first container when the first container is brought into alignment with the second container.

6. The hair dye applicator according to claim 1, wherein at least one of the first container or the second container further comprises at least one pellet, wherein the pellet facilitates a substantially thorough mixing of the first hair dye component and the second hair dye component.

7. The hair dye applicator according to claim 6, wherein the mesh screen is dimensioned to prevent egress of the pellet from the outlet upon removal of the closure.

8. The hair dye applicator according to claim 1, wherein the outlet is configured to receive a device capable of applying the mixture of the first hair dye component and the second hair dye component to at least a section of hair.

9. The hair dye applicator according to claim 8, wherein the device is selected from the group consisting of a comb, a brush and a sponge.

10. The hair dye applicator according to claim 1 further comprising a cap, wherein the cap is dimensioned such that it forms a substantially tight fit against the outlet.

11. The hair dye applicator according to claim 1, wherein a second end of the second container comprises a moveable end cap, and wherein the moveable end cap comprises an indentation on its outer surface for receiving a shifting device.

12. The hair dye applicator according to claim 11, wherein the shifting device enables the moveable end cap to be forced into the second container via the shifting device such that the mixture of the first hair dye component and the second hair dye component is pushed inward toward the outlet.

13. A method of dyeing hair, comprising:

(A) providing a hair dye applicator, wherein the hair dye applicator comprises: a first container, wherein the first container comprises a first hair dye component, wherein a first end of the first container comprises an outlet, wherein the first container further comprises a mesh screen, wherein the mesh screen is molded to an inside surface of the first container, and further wherein the mesh screen is interposed between an upper lip and a lower lip located in the first container; and a second container, wherein the second container comprises a second hair dye component, (B) engaging the first container and the second container such that a contiguous conduit is defined for the first hair dye component and the second hair dye component; and (C) mixing the first hair dye component and the second hair dye component.

14. The method according to claim 13, wherein the mixing is facilitated by at least one pellet, wherein the pellet is contained in the first container and/or in the second container.

15. The method according to claim 13, further comprising:

attaching a device to the outlet, wherein the device is capable of applying the mixture of the first hair dye component and the second hair dye component to at least a section of the hair; and applying a desired amount of the mixture to the section of the hair.

16. The method according to claim 15, further comprising retaining an unused amount of the mixture in the hair dye applicator, wherein the unused mixture is capable of being retained without substantial degradation for a period of 24-48 hours.

* * * * *